US006513974B2

(12) United States Patent
Malone et al.

(10) Patent No.: US 6,513,974 B2
(45) **Date of Patent: *Feb. 4, 2003**

(54) INFLATABLE INSULATING LINERS FOR SHIPPING CONTAINERS

(76) Inventors: Thomas G. Malone, P.O. Box 6727, San Diego, CA (US) 92166-6727; John J. McGraw, 7146 Tuliptree Trail, Indianapolis, IN (US) 46256-2137

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/156,208

(22) Filed: Sep. 17, 1998

(65) Prior Publication Data

US 2002/0064318 A1 May 30, 2002

(51) Int. Cl.[7] ..... B65D 30/00
(52) U.S. Cl. ..... 383/3; 383/110; 206/522
(58) Field of Search ..... 383/3, 110, 116; 206/522

(56) References Cited

U.S. PATENT DOCUMENTS

| | | | | | |
|---|---|---|---|---|---|
| 3,556,186 | A | * | 1/1971 | Besthorne | 383/3 |
| 3,730,240 | A | * | 5/1973 | Presnick | 383/110 X |
| 4,044,867 | A | * | 8/1977 | Fisher | 383/3 X |
| 4,091,852 | A | * | 5/1978 | Jordan et al. | 383/3 |
| 4,262,045 | A | | 4/1981 | Cheng et al. | |
| 4,284,674 | A | | 8/1981 | Sheptak | |
| 4,618,517 | A | | 10/1986 | Simko, Jr. | |
| 4,636,416 | A | | 1/1987 | Kratel et al. | |
| 4,669,632 | A | | 6/1987 | Kawasaki et al. | |
| 4,801,213 | A | * | 1/1989 | Frey et al. | 383/3 |
| 4,809,352 | A | * | 2/1989 | Walker | 383/3 |
| 4,826,329 | A | * | 5/1989 | Bellini | 383/3 |
| 5,180,060 | A | * | 1/1993 | Forti et al. | 206/522 |
| 5,217,131 | A | * | 6/1993 | Andrews | 206/522 X |
| 5,263,587 | A | * | 11/1993 | Elkin et al. | 383/3 X |
| 5,270,092 | A | | 12/1993 | Griffith et al. | |
| 5,314,250 | A | * | 5/1994 | Lee | 383/3 |
| 5,427,830 | A | * | 6/1995 | Pharo | 383/3 X |
| 5,454,642 | A | | 10/1995 | De Luca | |
| 5,588,532 | A | | 12/1996 | Pharo | |
| 5,706,969 | A | | 1/1998 | Yamada et al. | |
| 5,769,232 | A | * | 6/1998 | Cash et al. | 383/3 X |
| 5,820,268 | A | * | 10/1998 | Becker et al. | 383/110 X |
| 5,857,571 | A | * | 1/1999 | Tschantz et al. | 206/522 |
| 6,176,613 | B1 | * | 1/2001 | Chen | 383/3 |
| 6,283,296 | B1 | * | 9/2001 | Newmn | 383/3 X |

FOREIGN PATENT DOCUMENTS

| | | | | |
|---|---|---|---|---|
| DE | 2339078 | * | 2/1975 | 383/3 |
| DE | 2549179 | * | 6/1977 | 383/3 |
| DE | 27 50 819 | | 5/1979 | |
| FR | 2367671 | * | 5/1978 | 383/3 |

* cited by examiner

*Primary Examiner*—Jes F. Pascua
(74) *Attorney, Agent, or Firm*—Kenehan & Lambertsen, Ltd.; John C. Lambertsen

(57) ABSTRACT

An insulating bag is provided having an inflatable, double outer layer defining an interior container space for thermally-sensitive cargo. A surface reflective to radiant thermal energy lies within the inflated outer layer as a layer on an interior surface of the wall and/or as a surface formed on a baffle material lying within the inflated layer. The inner and outer layers of the double outer layers are attached to one-another in a series of attachment seams that together comprise configuration segments that, when inflated, provide structural definition to the interior containment space.

5 Claims, 7 Drawing Sheets

INFLATABLE INSULATING LINERS FOR SHIPPING CONTAINERS

BACKGROUND OF THE INVENTION

1. Field of the Invention

The present invention relates to thermally-insulated shipping containers and, more particularly, to shipping containers that are selectively inflatable. More specifically, the present invention relates to a pair of film layers having opposed reflective surfaces, and an optionally-interposed film baffle layer, that together define an inflatable envelope in the form of a flexible insulating bag.

2. Description of the Prior Art

In the transportation and distribution of products, the "shipping environment" is defined by both the product and the package. While the corrugated fiber board boxes, steel drums, wooden crates, and pallets have not changed significantly over the past 80 years, the shipping requirements of the products have changed with each new generation of both product and shipping technology. As a result, packaging materials have improved to meet the demands of the new technology.

Refrigerated transportation at one time meant a horse-drawn wagon packed with ice and straw. Super-cooled gases and microprocessor-controlled motors have replaced the earlier, primitive refrigeration techniques. Reliable, temperature-controlled, surface transportation is now available to and from almost anywhere in the world. Trucks and ocean container shipping utilize positive, mechanical refrigeration systems to retard spoilage in transit.

Such surface transportation is relatively slow, and the shipped goods must have a correspondingly long shelf life. However, many temperature-sensitive products, such as perishable foodstuffs, are time-sensitive as well. Successful long-distance shipping is only feasible where transportation time can be minimized.

Servicing a worldwide food market required yet another technological development—the generous cargo holds of newer, wide-body passenger jet aircraft in the late 1960's and early 70's. The drop in airfreight rates heralded by these new jets for the first time permitted the cost-effective transportation of perishable, medium-value commodities such as meat, seafood, and fresh produce.

Traditionally, such perishable foodstuffs, as well as pharmaceuticals, are cooled prior to shipment, then placed within a thermal insulating material, and shipped with only a modicum of ice or refrigerant to absorb the heat that flows through the insulation. For many years, molded expanded polystyrene ("EPS") containers have been the thermal insulating material of choice. The perishable goods are placed within the EPS containers, which are then in turn placed within small, corrugated shipping boxes.

EPS containers have been widely used since the lowered airfreight rates first made this form of shipment economically practical. While providing satisfactory insulation qualities as well as being light in weight, EPS also presents several negative characteristics to the shipping industry. EPS is an "expanded," non-compressible material, and consists of a very large number of small air bubbles formed in a polystyrene plastic matrix. EPS's poor volume efficiency increases shipment costs when transporting the empty containers to the location of their use, as well as causing increased warehousing costs when stored in inventory prior to use.

While providing reasonable protection from shock impacts during transit, EPS has poor resistence to the application of puncture and shear-loading. EPS easily fractures, requiring the use of an additional plastic liner bag when shipping products with a liquid component, such as ice-chilled, fresh seafood. The lack of such an additional plastic liner risks liquid leakage from the EPS container during shipment, and the resultant expensive damage to aircraft cargo holds or other corrosion-sensitive shipping environments.

In an effort to avoid EPS and its negative characteristics, a number of shippers have attempted to make use of metalized, radiant barrier bags. Relying on the property of shiny, metalized coatings to reflectively radiate heat energy, such products have found only marginal success as insulated packaging. Although reducing warehousing and breakage expenses, as well as enjoying lower manufacturing costs, many shippers have determined that such radiant bags do not control temperatures over a sufficiently long period of time.

Ideally, it would be desirable to provide an insulative system having a reliable thermal performance over extended time periods (at least 48 hours), which is leakproof, can be shipped and stored in a manner requiring less space than EPS, and that is fabricated out of materials and in a manner that remains cost-competitive with the EPS insulated box product.

It is thus an object of the present invention to provide a flexible insulating bag of collapsible design having equal thermal insulation to that provided by EPS. The reduction in storage and shipping volume of the collapsible bag over the EPS container translates into lower costs, enabling worldwide marketing by a single source of supply, permits distributors to economically inventory large quantities of different-sized shipping container bags, and permits shippers to maintain a greater inventory, requiring fewer deliveries as well as economically ship to remote packing locations to cost-effectively service the fresh market from more remote source regions.

It is a further object of the present invention to provide two reflective surfaces, one inside the hot face to function as a low-emissivity surface and one on the inside of the cold face, functioning as a radiant barrier.

It is another object of the present invention to provide an inflatable design, permitting collapse of the insulating container for efficient storage, and, when inflated, creating an airspace adjacent the reflective surfaces to empower a further reduction in heat flow, either by lower emissivity or greater reflectivity.

It is another object of the present invention to provide an alternate intermediate baffle design that incorporates the aforementioned double radiant barrier, in an insulating system that bisects the insulating, inflated chamber in a manner that further inhibits convective heat transfer.

It is a still further object of the present invention to fabricate such an insulating bag in a manner that utilizes a minimum number of processing steps to form all air-containing and shape-controlling structural features of the insulating bag, including the incorporation of a flat inflation valve and a closure securement system, such as a zip-closure.

It is another object of the present invention to include one or more uninflated gussets within a bottom panel of the insulating bag to receive and collect melted ice water and any liquid leakage from the shipped products, separating such liquid from the products enhancing freshness and minimizing contamination.

It is another object of the present invention to fabricate the flexible insulating bags out of film materials using rf welding to enable reliable, high volume manufacturing at low per-unit cost.

It is another object of the present invention to provide a flexible insulating bag that is inflated with air for normal insulating values, or may be optionally inflated with an inert, low conductivity gas, such as argon, to further enhance insulating performance.

It is another object of the present invention to permit the collapse of a used insulating bag by deflating same, reducing disposal costs, whether shipped for recyling or on the basis of a reduced amount of landfill volume required if discarded.

SUMMARY OF THE INVENTION

These and other objects of our invention are provided by a flexible insulating bag that utilizes an inflatable wall panel construction. A pair of opposed flexible plastic film layers form the walls, and they are inexpensively attached together by rf (radio-frequency) welding. The intricate pattern of attachment seams that connect the pair of film layers is used to define the individual inflatable wall panels, as well as the overall shape of the insulating bag upon its inflation.

The inflatable walls significantly reduce conductive heat losses through the insulating bag. An enhanced insulative performance can be obtained by replacing environmental air as the inflating gas with an inert, low conductivity gas, such as argon.

Further insulating enhancement can be obtained by minimizing losses caused by radiant heat transfer. One method of achieving lower radiant thermal losses utilizes a metalized reflective layer formed on one of the surfaces of the plastic film. When configured in a manner resulting in the placement of the reflective layer on the inner surface of the outer wall (which is normally the "hot face"), a low emissivity surface is obtained. A similar metalized surface provided on the opposing, inner surface of the interior wall film, normally the "cold face," acts as a radiant barrier.

An alternate strategy for minimizing radiant thermal losses (as well as convective heat losses), makes use of baffles placed within the inflated wall panels. One type of baffle relies upon a stiffened material, and will, if carefully dimensioned, self-center between contracting adjacent attachment seams during inflation of the wall structure. Emplacement of the stiffened baffles within the wall structure during the fabrication thereof may be obtained by providing a sheet of baffle material having slots formed therein that dimensionally conform in both size and location to the rf welding seams. The slotted baffle material is then received between the pair of plastic film layers prior to rf welding.

An alternative baffle material makes use of a continuous sheet of a flexible film having both surfaces metalized and rf-weldable. When placed between the plastic, outer wall film layers and alternately attached to interior and exterior liner walls, the flexible baffle material will kink during inflation of the wall. Such alternate attachment seams can easily be obtained by interweaving the flexible baffle sheet through a comb-shaped release form that is withdrawn prior to the making of a final weld to close off the wall panels.

The use of rf welding enhances the manufacturing efficiencies enjoyed by the use of plastic film layers from which to fabricate the insulated bag. When appropriately prefolded prior to welding, the plastic film layers and the detailed rf welding pattern jointly cooperate to minimize the number of welding passes required. Bag formation with an asymmetrical welding pattern requires two separate passes, with the second to secure the side panels together, forming the boxed ends.

Alternatively, the use of a symmetrical, single-pass welding pattern permits the formation of an enclosed bag, including all side sealing seams, and a double-flap instead of a single-flap enclosure lid. The inflatable portion of a single welding pass design is defined by a seam pattern that does not encompass the entire area of the opposing plastic film layers. Adjacent to the symmetrically-formed container floor portion are a pair of uninflated floor gussets. Upon opening the interior portions prior to receipt of the cargo to be shipped, the bottom gussets form a liquid reservoir suitable for receiving and holding any liquids as might drain from the cargo area. Such liquid drainage might be given off by the cargo itself, or result from meltwater from the cooling ice. Removal of such liquids from immediate contact with the shipped cargo reduces spoilage and extends the shipping life of the cargo.

Some further objects and advantages of the present invention shall become apparent from the following description, claims and drawings.

DETAILED DESCRIPTION OF THE PREFERRED EMBODIMENTS

Figure 1:
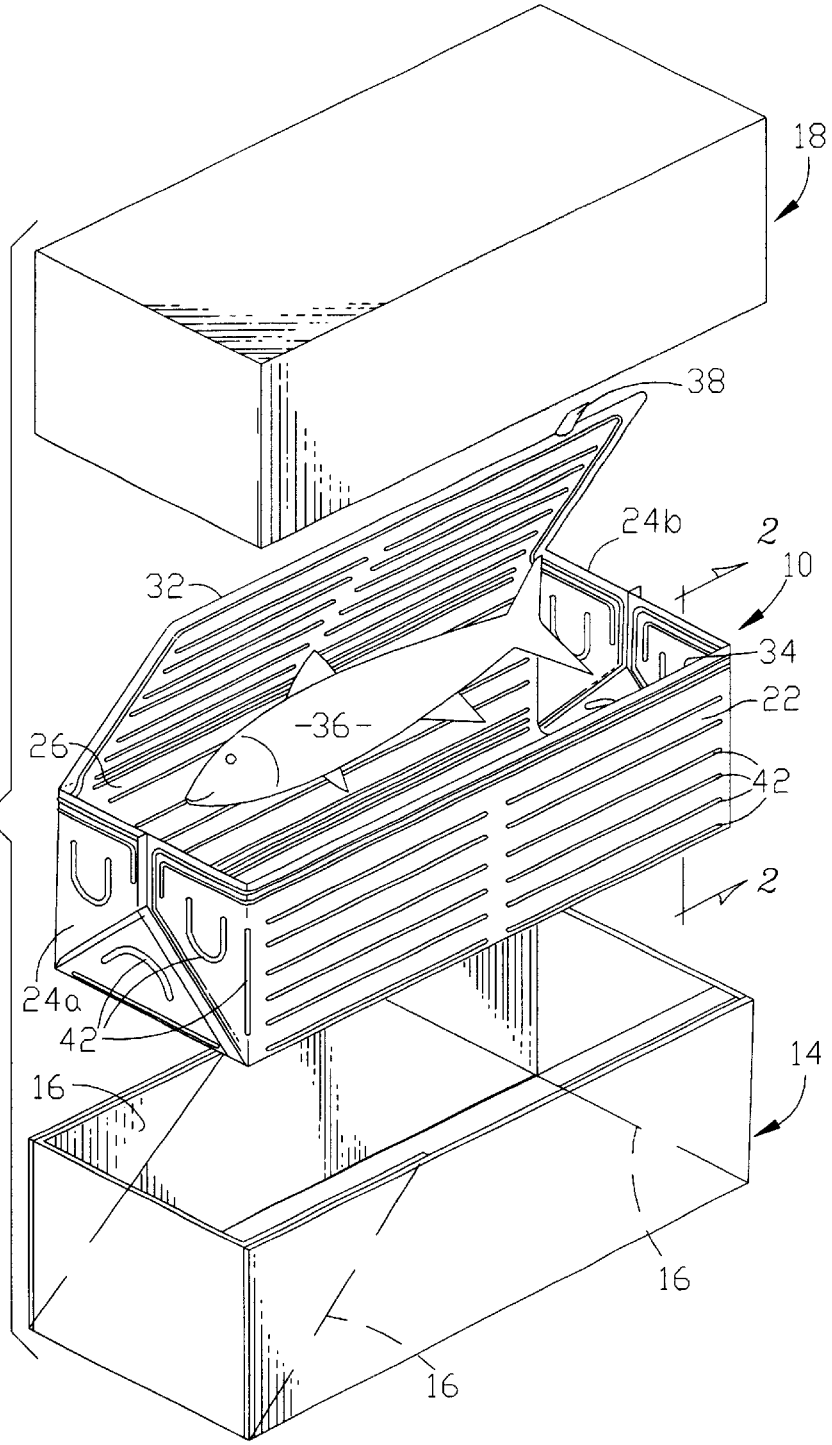
FIG. 1 is an exploded perspective view, with portions in phantom, showing an inflatable insulating shipping box liner receiving a seafood product for shipment, and placed within an outer shipping container in accordance with the present invention.

Reference is now made to the drawings wherein like numerals refer to like parts throughout. An inflatable insulating shipping box liner 10 is depicted in FIG. 1 as received within a transport box bottom 14. A pair of gussets 16 formed at each end of the transport box bottom 14 are preferably provided to minimize the likelihood of any liquid leakage from within the transport box bottom 14.

A transport box top 18 is received by the transport box bottom 14 in a fully telescoping manner, again minimizing the opportunity for the leakage of liquid from the contents carried within the transport box. Additionally, in a conventional manner the transport box bottom and top 14, 18 are both waxed to preserve their structural integrity against damage caused by liquids that have either leaked from the interior insulating shipping box liner or from liquids wetting an outer surface or surfaces thereof.

The inflatable insulating shipping box liner 10 includes a front wall 22, a pair of side walls 24*a*, 24*b*, a rear wall 26, a floor 28, and a top or covering flap 32, which together define an interior container space 34 suitable for the transport of perishable products, such as a fish 36 depicted in FIG. 1. The insulating shipping box liner 10 is preferably inflated once placed within the transport box bottom 14, prior or just after placement of the perishable product within the interior container space 34.

Air is introduced into the interior space lying within each of the various structures of the insulating shipping box liner 10 by an inflating valve 38. All structural portions of the insulating shipping box liner 10 are in fluid communication with one another, permitting air entering through the inflating valve 38 to flow into and inflate all portions of the inflating bag 10. A plurality of different-shaped inflation seams 42 govern the manner in which the various component portions of the insulating shipping box liner 10 inflate as well as their resulting configuration. The inflation seams 42 likewise define a plurality of inflated tubes that are of suitable cross-sectional dimension to provide the structural rigidity required of the various panel members of the insulating shipping box liner 10.

The function of the inflation seams 42 is best described with reference to FIG. 2. As is the case for each of the sections forming the insulating shipping box liner 10, the front wall 22 consists of an inner material layer 52 and an outer material layer 54. Upon the admission of air through the inflating valve 38 (or an inert gas such as argon, should greater insulating values be desired), the inner and outer material layers 52, 54 are separated by the incoming gas, and "balloon out." Along the inflation seams 42, the inner and outer material layers 52, 54 are joined to one-another, preventing their separation by the incoming charging gas.

In this manner, the placement of the inflation seams 42 define the shape of the inflated portions of the insulating shipping box liner 10. In FIG. 2, the latitudinal, spaced-apart inflation seams 42 create a vertical arrangement of horizontally-extending inflated tubes. Similar arrangements of the inflation seams 42 in the floor 28, the rear wall 26, and the top or covering flap 32 results in similar inflated horizontal tubular structures that extend the length of the insulating shipping box liner 10. The side walls 24*a*, 24*b* present a variation on this theme, with each consisting of a joined arrangement of three separate lateral panels 58*a*, 58*b*, 58*c*.

A first and a second of the lateral panels 58*a*, 58*b* are trapezoidal-shaped extensions of the front and rear walls 22, 26. A vertically-extending inflation seam 42 (shown in FIG. 1) separates the first and second lateral panels 58*a*, 58*b* from the adjoining portions of the respective front and rear walls 22, 26, and forms a side edge when the insulating shipping box liner 10 is inflated. The third lateral panel 58*c* is formed as a triangularly-shaped extension from the floor 28, with a linear inflation seam 42 (shown in FIG. 1) also separating these two panels. The adjoining lateral edges of the first, second, and third lateral panels 58*a*, 58*b*, 58*c* are joined together forming a tri-segment attachment seam 64 (FIGS. 2 and 3).

The lateral panels 58*a*, 58*b*, 58*c* each present a reduced inflated area, and thus a sequence of spaced longitudinal inflation seams 42 are not required. Instead, a centrally-located "U"-shaped inflation seam 42 is provided each of the lateral panels 58*a*, 58*b*, 58*c*. In a preferred embodiment, the base of the "U" in each of the panels is directed toward the angular side of the lateral panel or, in the case of the triangular, third lateral panel 58*c*, toward the apex of the triangle. As so positioned, the inflation seams 42 provide the appropriate restriction for limiting the balloon effect between the inner and the outer material layers 52, 54 in the lateral panels 58*a*, 58*b*, 58*c* of the inflatable insulating shipping box liner 10 to a specified inflated thickness of, by way of example and not limitation, one inch (1").

The extent or area over which the inner and outer material layers 52, 54 inflate is defined by a sealing seam 66 that continuously extends about the outer periphery of each of the individual panels making up the inflatable insulating shipping box liner 10. The air or inert gas is admitted through the inflating valve 38 and into the portion of the insulating shipping box liner 10 lying inside of the sealing seam 66. Once admitted, the sealing seam 66 prevents the gas from escaping, resulting in the inflation of this sealed portion of the insulating shipping box liner 10.

Figures 2, 3:
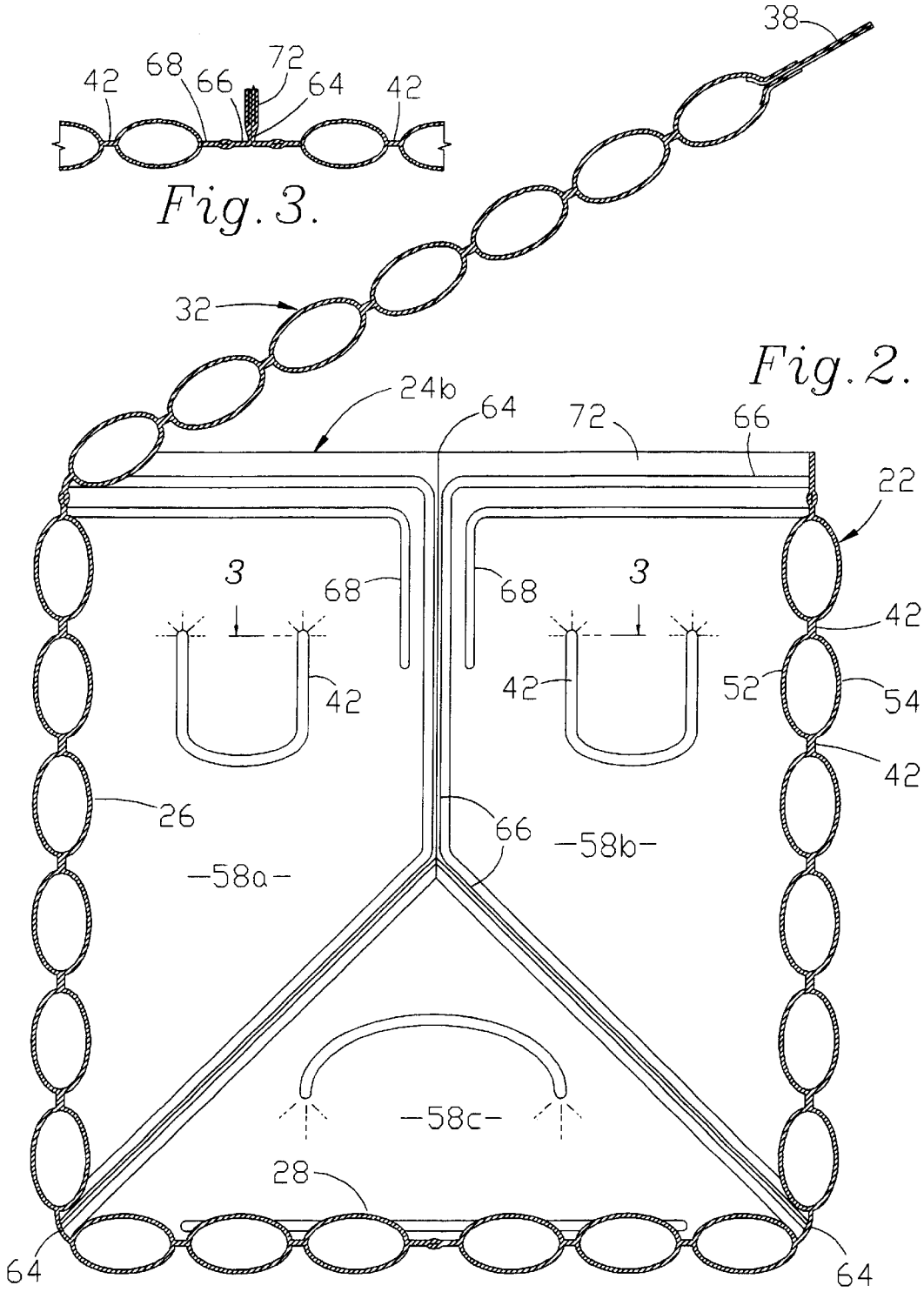
FIG. 2 is a cross-sectional view, taken along line 2—2 in FIG. 1, showing an inflatable insulating shipping box liner in accordance with the present invention.
FIG. 3 is a partial cross-sectional view taken along line 3—3 of FIG. 2, showing the manner in which two panels of an inflatable, insulating shipping box liner are joined together.

As shown in FIG. 2, a reinforcement seam 68 is spaced interiorly from and runs parallel to the sealing seam 66 along the top portion of the inflation bag 10. The reinforcement seam 68 acts to stiffen the upper portions of the insulating shipping box liner 10, as well as to better define the opening of the insulating shipping box liner 10 and thereby assist during the loading and unloading thereof. Exterior of the sealing seam 66 is located an uninflated flap 72. When the cover 32 is placed over the interior container space 34, the uninflated flaps 72 located circumferentially thereabout can be folded over the edges of the cover 32 to provide an additional measure of thermal sealing protection.

Figure 4:
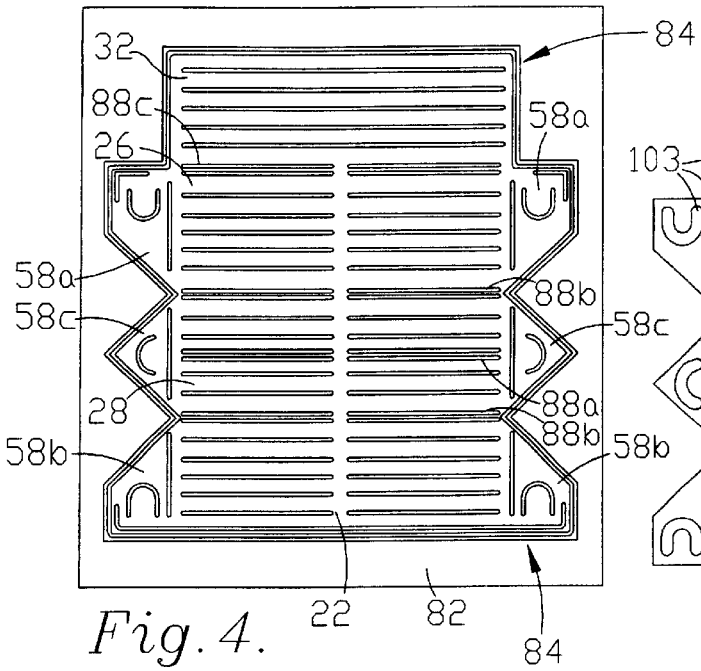
FIG. 4 is a top plan view, showing a weld pattern formed on a plastic substrate during the fabrication of an inflatable insulating shipping box liner in accordance with the present invention.

A presently preferred manner for fabricating the insulated bag 10 is shown in FIGS. 4 and 5A–D. Turning first to FIG. 4, a multi-layer sheetform substrate 82 has a multiple seam pattern 84 formed thereon. The sheetform substrate 82 preferably consists of two layers of a plastic material, and the seam pattern 84 is preferably formed thereon by radio-frequency welding. As so formed, the seam pattern 84 comprises both the individual panel construction of the insulating shipping box liner 10 as well as the inflation pattern thereof, as just discussed.

Each lateral portion of the seam pattern 84 defines the lateral panels 58*a*, 58*b*, 58*c* that, when attached together, form the pair of side walls 24*a*, 24*b* for the insulating shipping box liner 10. The seam pattern 84 also defines a series of rectangular sections that, when assembled, form the cover 32, the front and rear walls 22, 26, and the floor 28. Additionally, although not labeled to maintain drawing clarity, the initial fabrication step also forms the pattern of inflation seams 42, the sealing seams 66, and the reinforcement seams 68.

Four pairs of the inflation seams 42 are more closely spaced than is typical for the other inflation seams 42, and thereby form four folding seams 88 that simplify the succeeding fabrication procedures as well as form the bottom front and rear bag folding edges, and enable the easy closure of the cover 32. As shown in FIG. 4, a floor-folding seam 88*a* is centrally formed in the center of the floor 28, and is used to assist in the fabrication of the finished bag construction as is hereinafter discussed. A pair of parallel, edge-folding seams 88*b* are equally spaced-apart on either side of the floor seam 88*a*, and form the front and rear bottom edges in the finished insulating shipping box liner 10. Finally, a cover-folding seam 88*c* is formed at the joinder of the cover 32 and the rear wall 26, permitting the easy folding of the cover 32, even after inflation of the insulating shipping box liner 10.

Upon removal of the excess substrate material lying beyond the seam pattern 84 shown in FIG. 4, the remaining cut-out is ready for the final fabrication operations, which are best described with reference to FIGS. 5A–5D. In FIG. 5A, the front and rear walls 22, 26 are brought together by first folding on the edge-folding seams 88*b* and then collapsing together the floor 28 by oppositely folding on the floor-folding seam 88*a*. As properly folded, both resulting halves of the floor 28 are placed between the now-adjoining front and rear walls 22, 26 (also shown in FIG. 5B).

Figure 5C:
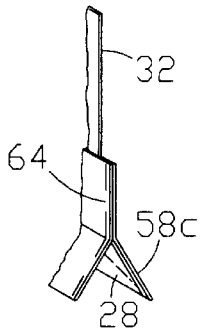
FIGS. 5A–D are front and side schematic views depicting the manner in which the welded plastic substrate of FIG. 4 is fabricated into an insulating box-like structure.
Figure 5A:
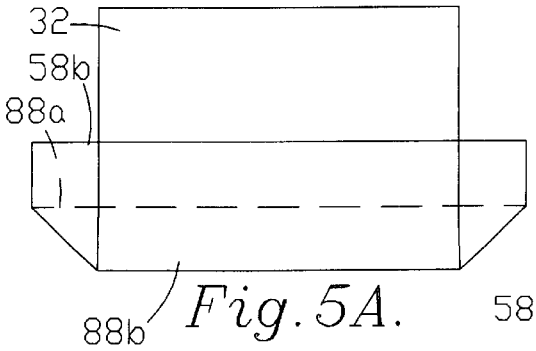
Figure 5B:
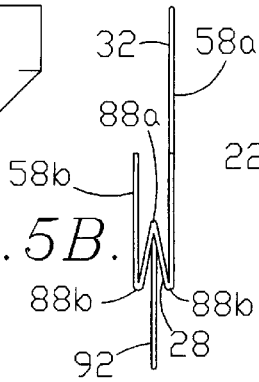
Figure 5D:
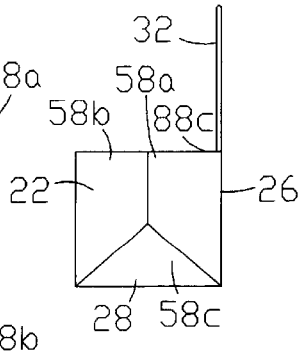

As so positioned, the lateral panels 58 engage one another along each of their respective lateral edges (best shown in FIG. 5C). The attachment seams 64 may now be formed, again, preferably by radio-frequency welding when plastic sheet substrates are used. In such an instance, a release sheet 92 is appropriately inserted between the lower half-panels of the floor 28 to prevent the inadvertent attachment of the angled edges of the front and rear wall lateral panels 58*a*, 58*b* to one another instead of to only the adjoining lateral edges of the floor lateral panel 58*c* during this second welding operation.

The resulting inverted "Y"-shaped attachment seams 64 are best shown in FIG. 5C, and illustrate the formation of the side walls 24*a*, 24*b* out of the three separate lateral panels 58*a*, 58*b*, 58*c*. Upon once again separating the front wall 22 from the rear wall 26, the now-attached separate lateral panels 58 expand to form the side walls 24. The resemblance of the insulating shipping box liner 10 to a box-like structure is now apparent, requiring only inflation prior to its use.

In a preferred embodiment, the inner material layer 52 is metallized to function as a radiant barrier and the outer material layer 54 is metallized to function as a low emissivity surface, greatly enhancing the insulating qualities of the inflatable insulating shipping box liner 10 in comparison to the insulative effect of inflation alone. Since considerable manufacturing economies are obtained by relying upon radio frequency welding, and with thermal performance significantly improved by metallizing the inner and outer material surfaces 52, 54, the materials selected for fabricating these layers must be capable of rf welding and be metallized. It has proven to be somewhat difficult to reconcile these two features.

Although materials testing continues, the most likely solution presently appears to be a three-sheet laminate consisting of an outer blended polyolefin film layer containing polyethylene and either ethylene vinyl acetate (EVA) or ethylene methyl acrylate (EMA) to enhance its RF weldability, an inner metallized polyester film, and a second blended polyolefin film layer containing polyethylene and EVA or EMA to form the laminated structure.

In addition to its ability to be RF welded, the polyolefin film also provides good puncture resistance. Unfortunately, polyethylene film does not metallize well, and it does not resist stretching—which potentially permits the overfilling of the inflatable insulating shipping box liner 10. Polyester film, in addition to being readily metalized, does not stretch yet provides a good burst strength. Together, this laminate forms a firm packaging material, with the inflation thereof through a flat, plastic valve such as those manufactured by Sealed Air Corporation of New Jersey for use in their air-filled packaging systems.

Based upon some early prototype work, producing such a laminate has proven to be somewhat difficult to accomplish in the large quantities required for its economical use in the present packaging system. If such a laminate is not uniform when produced in larger quantities, its failure, even on a "spot" or partial basis, would significantly erode the beneficial insulating qualities of the inflatable insulating shipping box liner of the present invention.

Figure 6:
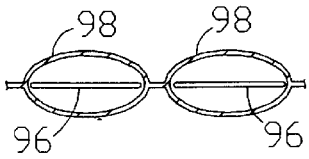
FIG. 6 is a partial cross-sectional view showing the manner in which a baffle material is received within the inflatable pattern formed in the plastic substrate shown in FIG. 4.

A presently preferred alternative insulating system instead relies upon interior baffles that are provided with a radiational barrier surface. Turning now to FIG. 6, a pair of internal baffles 96 are shown received within an adjoining pair of inflated insulated cells 98 of the insulating shipping box liner 10. These internal baffles 96 are depicted as centered within the insulated cells 98, which occurs upon inflation as a result of the careful dimensioning of the internal baffles 96. Specifically, a lateral dimension of the internal baffles 96 is selected such that upon the inflation of the insulating cells 98, the resulting balloon-expansion of the inner and the outer material layers 52, 54 causes a contraction of the parallel seams adjacent to both sides of the inflation cells 98, with the internal baffles 96 self-centering in the widest part of the insulating cells 98.

Figure 7:
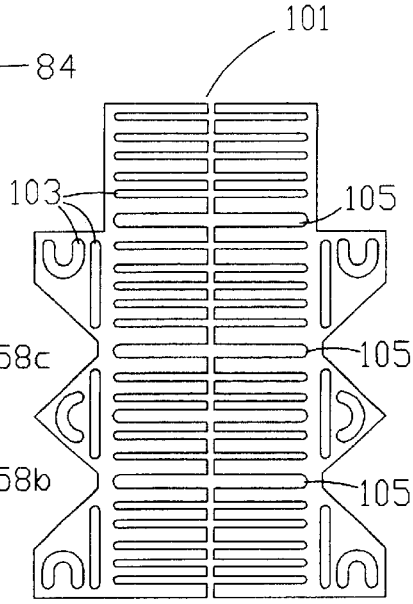
FIG. 7 is a partial top plan view of a baffle material, showing a cut-out pattern corresponding to the weld pattern shown in FIG. 4.

A presently preferred technique for placement of the internal baffles 96 within the individual insulating cells 98 formed in the insulating shipping box liner 10 is to form the baffle material as a single cut-out that can be received between the inner and outer material layers 52, 54 at the time of fabricating the insulating shipping box liner 10. As shown in FIG. 7, such a scheme results in a baffle cut-out sheet 101 having a plurality of inflation seam openings 103 formed therein at locations corresponding to each location in which the inflation seams 42 are formed in the sheetform substrate 82, as well as a plurality of folding seam openings 105 formed at locations corresponding to the folding seams 88 (compare FIGS. 4 and 7).

Attachment of the top and bottom material layers of the sheetform substrate 82 by RF welding thereby integrates the inner and outer material layers 52, 54 with the intermediate baffle cut-out sheet 101, creating a single, multi-layered material. Subsequently folding and RF welding a second time completes the insulating shipping box liner 10 in the manner previously discussed (see FIGS. 5A–D).

Initial studies have indicated the suitability of a kraft paper and foil paper laminate as the baffle material. It is light in weight and easily formed into the complex pattern required of the baffle cut-out sheet 101. Also, by providing a foil paper laminate on both sides of the kraft paper, a double radiant barrier is formed within each of the inflated insulating cells 98. Lamtite of New Jersey manufactures such a product under the name "Foil-Kraft-Foil."

In another preferred embodiment, the baffle may be a continuous sheet that is welded in place during the fabrication of the insulating liner. The arrangement of its welds forms a honeycomb-type structured layer out of the continuous sheet, eliminating the requirement that the baffle be die-cut in a manner mimicking the pattern of the subsequently-welded seams. Such a baffle material must be metallized and rf weldable on both sides, and when attached to alternate interior and exterior liner walls, will kink or separate during inflation of the liner, resulting in a honeycomb structure that further increases the thermal efficiency of the inflatable insulating liner. The thermal properties and characteristics of such a honeycomb structure are described in Griffith, et al., U.S. Pat. No. 5,270,092, owned by the Lawrence Berkeley National Laboratory of the University of California.

Figure 8:
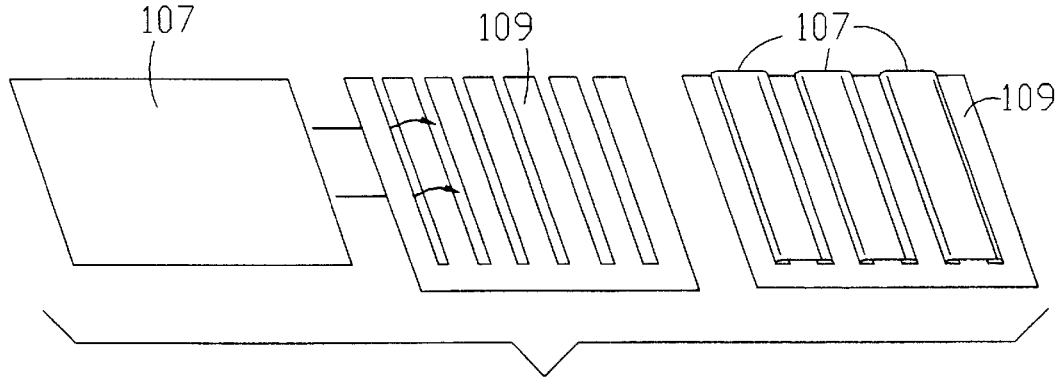
FIG. 8 is an exploded perspective view, with portions in phantom, showing a flexible baffle sheet as received upon a comb-shaped release form in accordance with the present invention.
Figure 9:
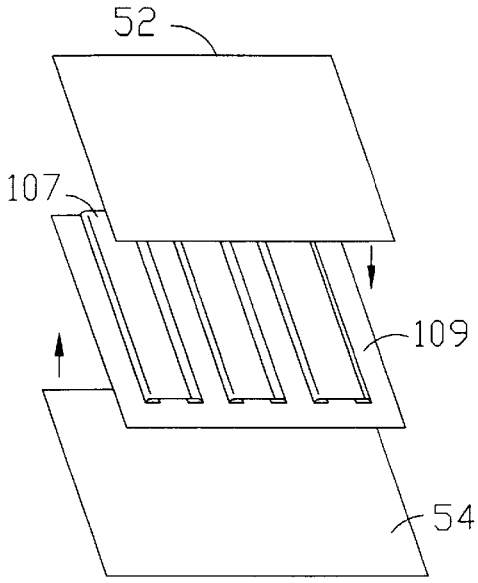
FIG. 9 is an exploded perspective view, with portions in phantom, showing a flexible baffle sheet and comb-shaped release form as received between an inner and an outer film layers in accordance with the present invention.

A presently preferred method of obtaining such a structure within an insulating liner in accordance with the present invention is depicted in FIGS. 8–12. In FIG. 8, a baffle sheet 107 is fabricated out of a material such as polyethylene film, metalized on one side, with that same side then laminated to a second layer of polyethylene film. The baffle sheet 107 is woven through a comb-shaped release form 109, with the baffle sheet 107 covering alternating fingers of the release form 109 as is depicted in FIG. 8. The interwoven comb-structure is then placed between the inner material layer 52 and the outer material layer 54 (shown in FIG. 9).

Figure 10:
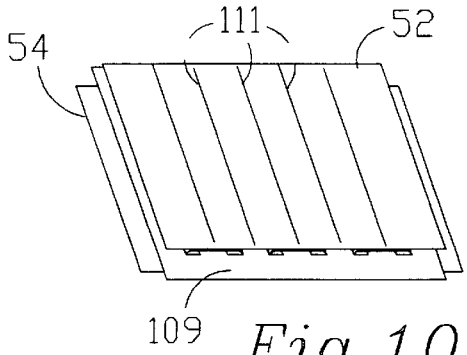
FIG. 10 is a perspective view, with portions in phantom, showing a flexible baffle sheet and comb-shaped release form after attachment of the baffle sheet to the inner and outer film layers in accordance with the present invention.
Figure 11:
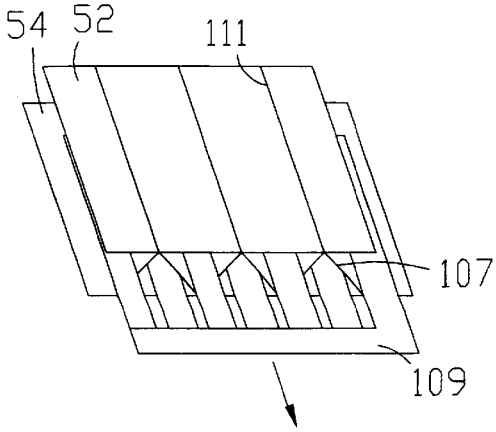
FIG. 11 is a perspective view, with portions in phantom, showing a partially separated pair of inner and outer film layers with a flexible baffle sheet extending in an alternating manner therebetween, with a comb-shaped release form in the process of being removed therefrom in accordance with the present invention.
Figure 12:
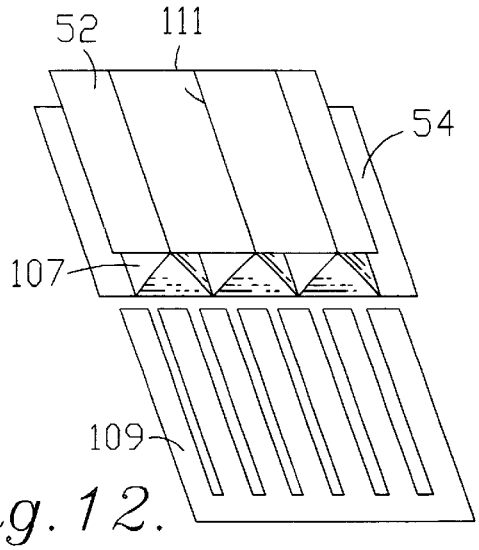
FIG. 12 is a perspective view, with portions in phantom, showing a separated pair of inner and outer film layers with an intermediate flexible baffle, after removal of the comb-shaped release form in accordance with the present invention.

A plurality of spaced weld lines 111 are depicted in FIG. 10, with each of the weld lines 111 centrally located over each finger of the release form 109. With the baffle sheet 107 alternating over and under each of the fingers of the release form 109, as shown with the release form 109 partially withdrawn in FIG. 11, the baffle sheet 107 attaches to the inner material layer 52 by a weld 111 at those locations where it overlies the fingers. Similarly, where the baffle sheet 107 is woven under the fingers, it is attached by a weld (not shown) to the outer material layer 54, creating the alternating lines of attachment shown in FIG. 12. A final weld is then made to close off the interior portion.

Other baffle materials are feasible, and a further preferred embodiment contemplates the use of a "phase change" material in a baffle, either replacing the kraft paper substrate or as another layer formed therein. In one contemplated embodiment, the kraft paper is replaced by a thermoset polyurethane foam, with a radiant outer barrier formed on its outer surface, such as by the attachment of aluminum foil layers.

Dispersed within the foam layer are molecules selected to undergo a phase change in the appropriate temperature range. This range can be varied by the manufacturer of the phase change molecules to maximize the performance of thermal protection for various shipping environments. In changing phases, these phase change molecules absorb heat from the environment. By so doing, these molecules significantly reduce the transfer of heat through the baffle material, enhancing the insulating qualities obtained over the radiant barrier alone.

Returning to the insulating shipping box liner, the fabrication process depicted in FIGS. 4 and 5A–5D requires two separate RF welding operations ("2-Hit Design"). In a preferred embodiment depicted in FIG. 13, a single RF weld creates a "1-Hit" insulating shipping box liner 115 (shown in FIG. 14). The sheetform substrate 82 is laid out identically to that previously described, including the insertion of the baffle cut-out sheet 101 (not shown) where this additional insulation is desired. The sheetform substrate 82 is then folded upon itself, along a fold line 117. A release paper (not shown) having dimensions ¼" less in width than the sheetform substrate is inserted between the folded sheets, and is sufficiently long to extend out therefrom, preventing the top and bottom edges of the substrate from being adhered together during the welding operation that follows.

Figure 13:
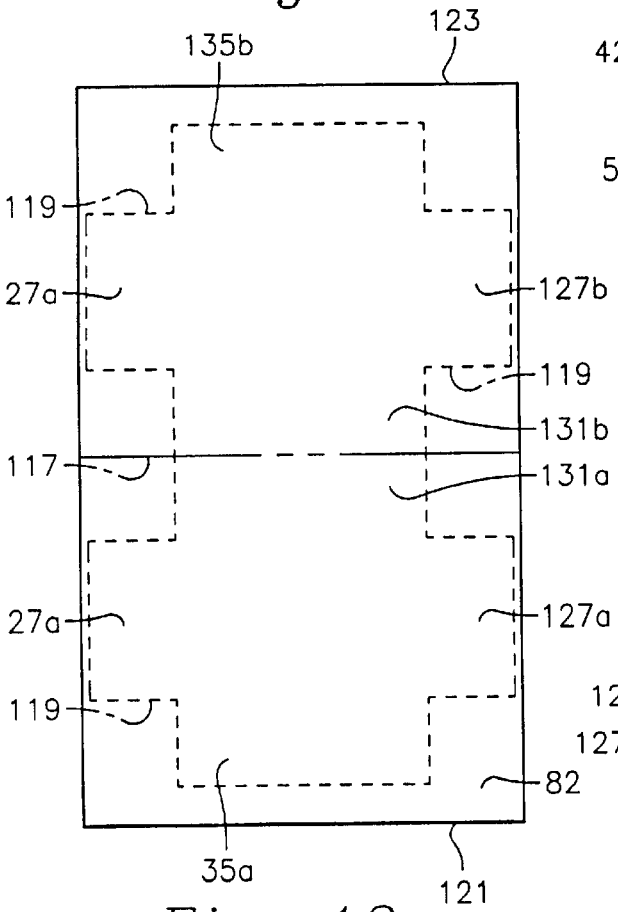
FIG. 13 is a top plan view showing a weld pattern in a plastic substrate that defines the inflated portion of an alternative insulating shipping box liner in accordance with the present invention.

Preferably, as with the "2-Hit Design," an RF welding operation (not depicted in the Figures) is used to form a "1-Hit" seam pattern 119 within the folded sheetform substrate 82. In FIG. 13 the non-folded outline of such a pattern is shown, which is symmetrical about a linear axis formed by the fold line 117. The "1-Hit" seam pattern 119 defines the perimeter of the inflated portion of the "1-Hit" insulating shipping box liner 115. The outer periphery forms a pair of lateral seams of attachment 120, which attach the overlying sheetform substrates except at an opposing pair of upper and lower longitudinal edges 121, 123.

Figure 14:
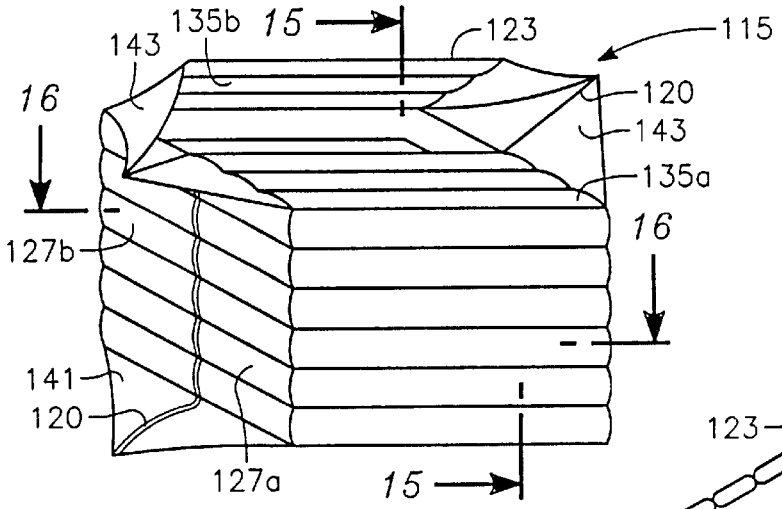
FIG. 14 is a perspective view showing the alternative inflatable insulating shipping box liner of FIG. 13 in accordance with the present invention.

The symmetrical folding of the sheetform substrate prior to RF welding results in the formation of a pair of front/back sidewall sections 127*a*, 127*b*. The floor is likewise separated by the fold line 117 into a pair of front/back floor sections 131*a*, 131*b*. Upon such RF welding, the front/back sidewall sections 127*a*, 127*b* and the front/back floor sections 131*a*, 131*b* cooperate to create an interior fluid containment space upon inflation of the shipping box liner 115, as is best illustrated by FIG. 14. Finally, the seam of attachment 120 does not extend along the upper and lower longitudinal edges 121, 123, thereby forming a pair of front/back cover sections 135*a*, 135*b*. The location of each of such sections after RF welding is depicted in FIG. 14.

As noted previously, the inflatable portion defined by the "1-Hit" seam pattern 119 does not encompass the entire area of the sheetform substrate 82. The uninflated portion adjacent to the front/back floor sections 131*a*, 131*b* forms a pair of floor gussets 141 (only one shown in FIG. 14). A pair of partial cover gussets 143 are formed adjacent to the front/ back cover sections in a similar manner, excepting a non-joined portion that reflects the lack of a seam of attachment along the upper and lower longitudinal edges 121, 123. The floor gusset 141 and the partial cover gusset 143 assist in providing additional sealing protection against liquid leakage from within the "1-Hit" insulating shipping box liner. Additionally, by forming a reservoir to remove from product interface liquids draining from the product, whether as a result of melting ice or natural product exudate, the gusset reservoir enhances product freshness and shelf life.

Figure 15:
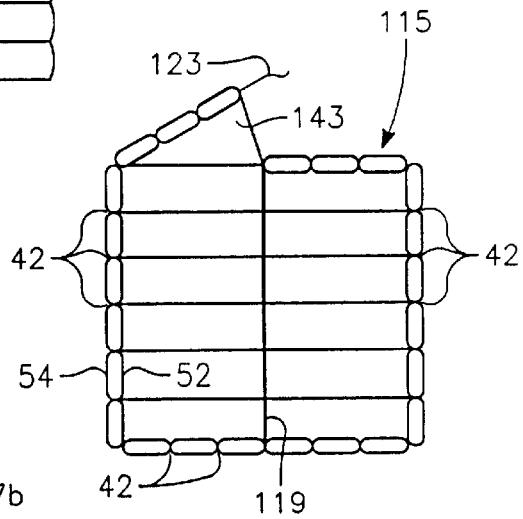
FIG. 15 is a cross-sectional view, taken along line 15—15 in FIG. 14, showing an alternative inflatable insulating shipping box liner in accordance with the present invention.
Figure 16:
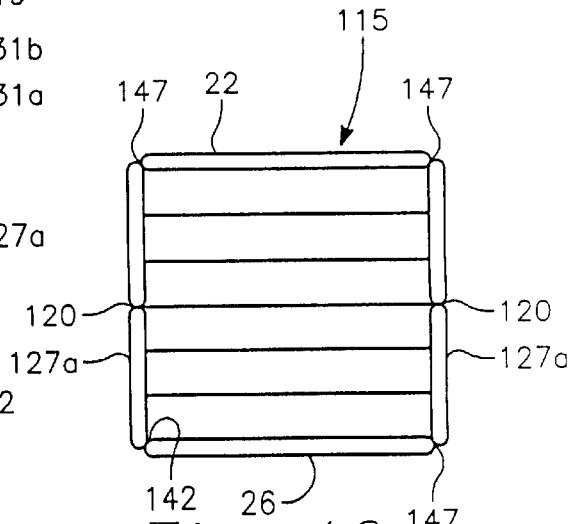
FIG. 16 is a cross-sectional view, taken along line 16—16 in FIG. 14, showing the sequence of insulating bladders defining an outer periphery of the inflatable insulating shipping box liner in accordance with the present invention.

For purposes of clarity, the inflation seams and attachment seams have been omitted from the "1-Hit" design layout shown in FIG. 13. As is shown in FIGS. 15 and 16, however, the inflation pattern formed in the "1-Hit" insulating shipping box liner 115 is similar, although less complex than with the "2-Hit" insulating shipping box liner 10 of FIG. 1. Without the lateral panels 58 forming the side walls 24*a*, 24*b*, the 1-Hit insulating shipping box liner 115 requires only a latitudinal pattern of inflation seams 42.

Upon the inflation thereof, a series of vertically-arranged, horizontally-extending insulating tubes results, with each tube extending from and between the pair of lateral seams of attachment 119 (see FIG. 16). In a preferred embodiment, a plurality of corner fold seams 147 (shown in FIG. 16) are formed adjacent to the front/back sidewall sections 127*a*, 127*b* during the fabrication of the "1-Hit" insulating shipping box liner 115. The corner fold seams 147 permit the easy bending of the insulating tubes when transitioning from the front and rear walls 22, 26 to the side walls 127.

Figure 17:
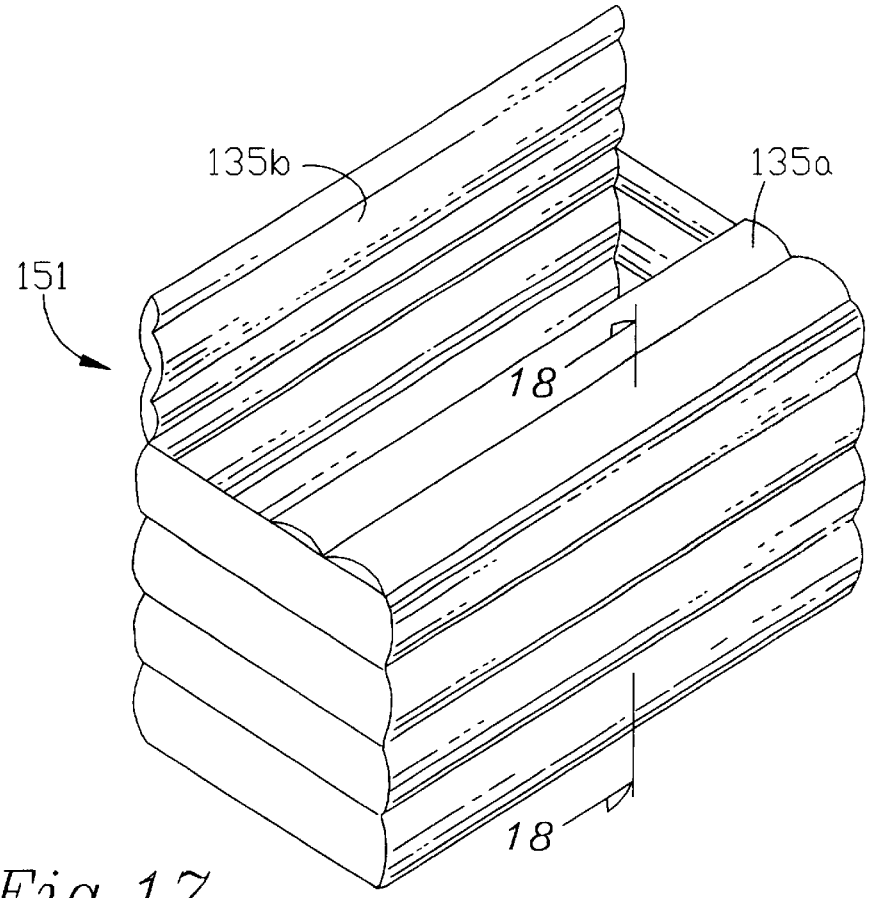
FIG. 17 is a perspective view showing an alternative inflatable insulating shipping box liner having a honeycomb-baffle container liner in accordance with the present invention.
Figure 18:
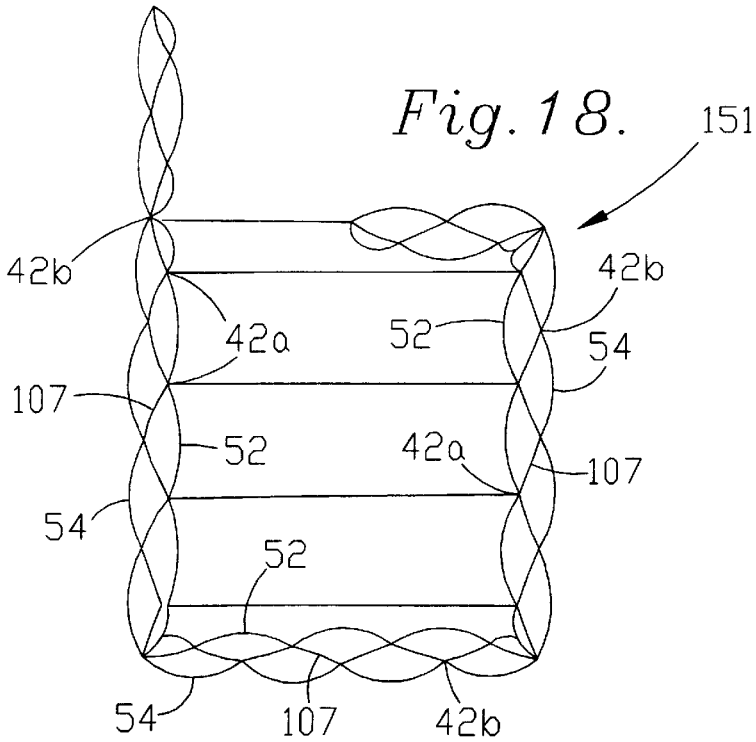
FIG. 18 is a cross-sectional view, taken along line 18—18 in FIG. 17, showing the honeycomb-baffle container liner in accordance with the present invention.

When the honeycomb-type structured layer utilizing the single sheet baffle discussed in association with FIGS. 8–12 is used to create a shipping container, one such container, a honeycomb-baffle container liner 151 is shown in FIGS. 17 and 18. In a similar construction to the 1-hit insulating shipping box liner 115, the front and back cover sections 135*a*, 135*b* thermally secure the interior containment space of the honeycomb baffle container liner 151.

FIG. 18 best depicts the manner in which the continuous baffle sheet 107 forms the honeycomb sections as it alternates its seams of attachment between the inner material layer 52 and the outer material layer 54. At each seam of attachment, an inner inflation seam 42A or an outer inflation seam 42B is created. Where the continuous baffle sheet 107 is provided a metalized, reflective surface, a continuous radiant barrier is formed within an inflated envelope, placing the barrier adjacent the air space required for its maximum effectiveness.

The majority of shipping containers used for fresh flowers, seafood, produce and the like measure 24" by 14", and are 12" in height. A suitable "2-Hit" inflatable insulating shipping box liner 10 would have (when inflated) a floor of measurements 24" by 14", front and rear walls of height 12", and a cover having dimensions of 24" by 14". A suitable thickness (when inflated) for maintaining a desired temperature for 48 hours is 1". A "1-Hit" insulating shipping box liner 115 would have similar dimensions, except that each of its two covers would have dimensions of 24" by 7". The present invention of dimensions suitable for such a typical shipping box would measure 38" by 27" by ½" thick, when deflated for shipment. Having cubic dimensions of only 0.30 cubic feet during shipment, the insulating liner of the present invention compares quite favorably to the much more bulky EPS shipping container that would require 2.25 cubic feet for supply shipment and inventory storage.

Figure 19:
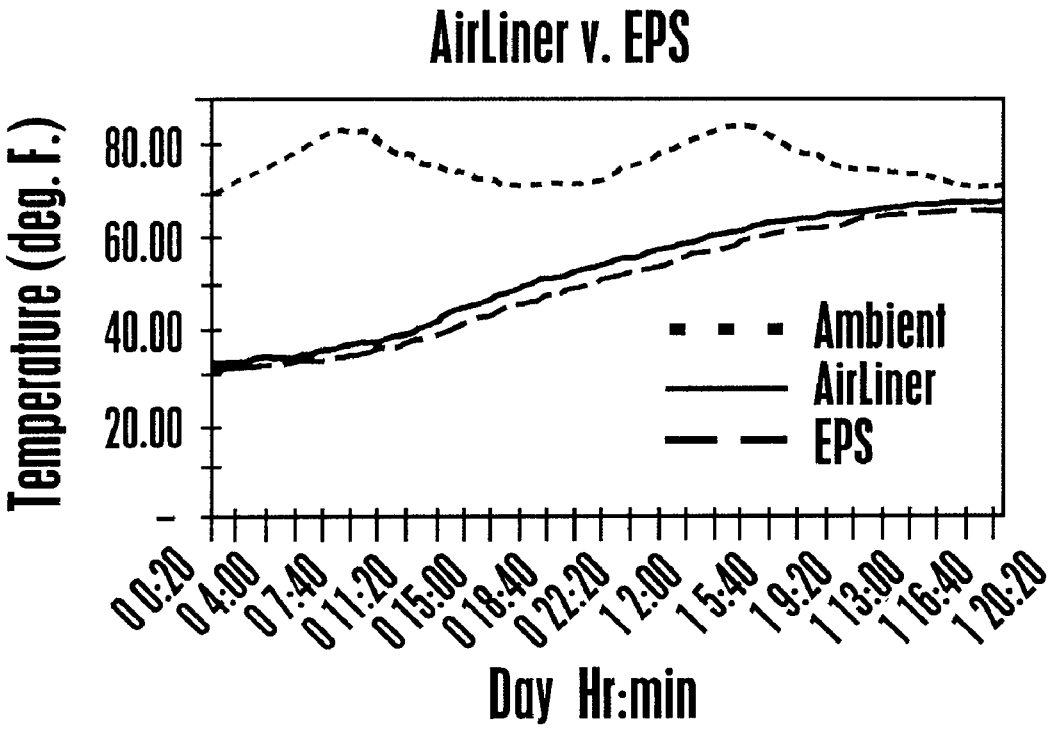
FIG. 19 is a graph comparing temperature changes over time experience by cargo insulated using a liner employing the present invention and a competitive technology.

The graph of FIG. 19 compares internal "product" temperatures over time as occurred between an inflatable insulating shipping box liner placed within an outer corrugated shipping container and an EPS shipping container similarly placed within such a shipping container. The ambient temperature varies over time as is indicated in FIG. 19.

Our invention has been disclosed in terms of a preferred embodiment thereof, which provides an improved insulating cargo containment system that is of great novelty and utility. Various changes, modifications, and alterations in the teachings of the present invention may be contemplated by those skilled in the art without departing from the intended spirit and scope thereof. It is intended that the present invention encompass such changes and modifications.

We claim:

1. An inflatable cargo container liner providing a substantially rectangular footprint when inflated comprising:

a substantially rectangular multi-layer sheetform substrate;

an outer seam extending about a peripheral edge of said sheetform substrate defining an envelope;

an inflation seam continuously formed within said envelope defining a plurality of inflatable side, top, and bottom panels and a pair of uninflatable panels, each of said uninflatable panels extending between a lateral edge of said inflatable bottom panel and between opposing lateral edges of an adjoining pair of inflatable side panels; and a valve in fluid communication with said plurality of inflatable side, top, and bottom panels, whereby said bottom panel, said pair of uninflatable panels, and each of said adjoining pairs of side panels cooperate upon inflation to form a sealed container of substantially rectangular form.

2. An inflatable cargo container liner comprising:

an inner material layer and an outer material layer attached to one another in a manner defining a sheetform envelope having a pair of opposed inner walls;

an inflation seal coupling said inner material and outer material layers in a manner to form a plurality of interconnected inflatable chambers and a plurality of uninflatable gussets; and a valve in fluid communication with said plurality of interconnected inflatable chambers, wherein said plurality of uninflatable gussets are distributed amono said inflatable chambers in a manner such that upon the inflation of said sheetform envelope said uninflatable gussets and said inflatable chambers cooperate to provide a substantially rectangular footprint for said cargo container liner.

3. A cargo container liner according to claim 2, wherein said inflation seal comprises a plurality of configuration segments that upon inflation of said sheetform envelope provide structural definition to said cargo container liner.

4. An cargo container liner according to claim 3, wherein a first portion of said configuration segments define a sequence of longitudinally-extending insulating bladders.

5. An insulating liner according to claim 4, wherein upon inflation of said sheetform envelope said longitudinally-extending insulating bladders define a top, a bottom, and a pair of opposed side panels.

* * * * *